United States Patent [19]

Motai et al.

[11] Patent Number: 4,944,252

[45] Date of Patent: Jul. 31, 1990

[54] REHEAT TYPE EXHAUST GAS BOILER

[75] Inventors: Toshiki Motai; Masamichi Kashiwazaki, both of Tokyo, Japan

[73] Assignee: Mitsubishi Jukogyo Kabushiki Kaisha, Tokyo, Japan

[21] Appl. No.: 412,323

[22] Filed: Sep. 25, 1989

[30] Foreign Application Priority Data

Jul. 25, 1988 [JP] Japan ..... 63-183677

[51] Int. Cl.[5] ..... F22G 7/12

[52] U.S. Cl. ..... 122/470; 122/7 R

[58] Field of Search ..... 122/7 R, 470, 406 S

[56] References Cited

U.S. PATENT DOCUMENTS

| | | | |
|---|---|---|---|
| 2,170,345 | 8/1939 | Bailey et al. | 122/406 S |
| 2,699,758 | 1/1955 | Dalin | 122/1 A |
| 3,254,631 | 6/1966 | Taylor | 122/7 R |
| 4,188,916 | 2/1980 | Csathy et al. | 122/7 R |
| 4,430,962 | 2/1984 | Miszak | 122/406 S |
| 4,664,067 | 5/1987 | Haneda et al. | 122/7 R |
| 4,685,426 | 8/1987 | Kidaloski et al. | 122/470 |
| 4,693,213 | 9/1987 | Yanai et al. | 122/470 |
| 4,858,562 | 8/1989 | Arakawa et al. | 122/470 |

FOREIGN PATENT DOCUMENTS

| | | | |
|---|---|---|---|
| 2950622 | 10/1981 | Fed. Rep. of Germany | 122/406 S |

*Primary Examiner*—Edward G. Favors
*Assistant Examiner*—Denise Ferensic
*Attorney, Agent, or Firm*—Wenderoth, Lind & Ponack

[57] ABSTRACT

A known reheat type exhaust gas boiler of the type having superheaters and reheaters disposed in parallel in the most upstream portion of an exhaust gas boiler main body, is improved by simplifying the structure and providing more effective recovery of heat from the exhaust gas. The superheaters and reheaters are divided into a plurality of stages. A high-temperature side superheater and a high-temperature side reheater are disposed in parallel in the most upstream portion of the gas flow. A low-temperature side reheater is disposed on the downstream side of the high-temperature side superheater, while a low-temperature side superheater is disposed on the downstream side of the high-temperature side reheater. The high-temperature side superheater and the high-temperature side reheater are formed so as to have an identical heat transfer tube outer diameter, an identical tube pitch in the transverse direction of the main body, an identical tube pitch in the longitudinal direction and an identical number of tube rows in the longitudinal direction. Likewise, the low-temperature side reheater and the low-temperature side superheater are formed so as to have an identical heater transfer tube outer diameter, an identical tube pitch in the transverse direction of the main body, an identical tube pitch in the longitudinal direction and an identical number of tube rows in the longitudinal direction.

2 Claims, 3 Drawing Sheets

REHEAT TYPE EXHAUST GAS BOILER

BACKGROUND OF THE INVENTION

1. Field of the Invention:

The present invention relates to a reheat type exhaust gas boiler in which superheaters and reheaters are disposed in parallel in the most upstream portion in the direction of exhaust gas flow of an exhaust gas boiler main body.

2. Description of the Prior Art:

Exhaust gas boilers for recovering heat of exhaust gases discharged from various heat generating sources such as gas turbines, diesel engines, cement calcinators or the like are well known and are exemplified by the exhaust gas boiler disclosed in Laid-Open Japanese Patent Specification No. 61-186702 (1986).

A prior art exhaust gas boiler is shown in FIGS. 3 and 4 and includes two sets of secondary superheaters 102 and secondary reheaters 103 disposed in parallel in the most upstream portion in the direction of exhaust gas flow of an exhaust gas boiler main body 101 through which exhaust gas flows longitudinally in the horizontal direction. Primary reheaters 104 are disposed on the downstream sides of the secondary superheaters 102, respectively, and primary super-heaters 105 are disposed on the downstream sides of the secondary reheaters 103, respectively. A high-pressure evaporator 106 is disposed downstream of the primary reheaters 104 and primary superheaters 105 transverse to the direction of exhaust gas flow.

On the downstream side of this high-pressure evaporator 106 is disposed a high-pressure economizer 107, and on the downstream side of this high-pressure economizer 107 are successively disposed a low-pressure superheater 108, a low-pressure evaporator 109 and a low-pressure economizer 110.

A high-pressure steam drum 111 and a low-pressure steam drum 112 are disposed above the exhaust gas boiler main body.

The high-pressure steam drum 111 is connected to an outlet of the high-pressure economizer 107, and also connected to a bottom header **106*a* of the high-pressure evaporator 106 via a down tube 113. In addition, a top header 106*b* of the high-pressure evaporator 106 is connected to the high-pressure steam drum 111 via a riser tube 114. Furthermore, a steam section of the high-pressure steam drum 111 is connected to an inlet section of the primary superheater 105 via a steam pipe 115**.

Whereas, the low-pressure steam drum 112 is connected to an outlet of the low-pressure economizer 110 and also connected to a bottom header **109*a* of the low-pressure evaporator 109 via a down tube 116. In addition, a top header 109*b* of the low pressure evaporator 109 is connected to the low-pressure steam drum 112 via a riser tube 117. Furthermore, the low-pressure steam drum 112 is connected to an inlet side of the high-pressure economizer 107 via a feed water pipe 119 provided with a feed water pump 118. And, a steam section of the low-pressure steam drum 112 is connected to an inlet section of the low-pressure superheater 108 via a steam pipe 120**.

In addition, an inlet of the primary reheaters 104 is communicated with a steam turbine not shown through a pipe for returning steam which has done work in the steam turbine. An outlet of the primary reheaters 104 is communicated with the secondary reheaters 103 through a communication pipe not shown. Likewise, an outlet of the primary superheaters 105 is communicated with the secondary superheaters 102 through a communication pipe not shown. And, partition walls 121 are provided between these mutually parallel superheaters and reheaters.

It is to be noted that means for lowering steam temperature are provided midway in the above-described communication pipes and rely upon water spray, water injection or the like to regulate the steam temperature.

The operation of the above-described prior art exhaust gas boiler will now be described.

Exhaust gas discharged from a heat generating source flows into the inlet of the exhaust gas boiler main body 101, is cooled by heat exchange with fluid flowing through heat transfer tubes of the various units 102–110 as it flows about the secondary superheaters 102, the secondary reheaters 103 and through the units 104–110, and flows out through the outlet of the exhaust gas boiler main body 101.

On the other hand, feed water (condensate) is sent to the low-pressure economizer 110 by means of a condensate pump (not shown), and is there heated by the exhaust gas. Then, the heated feed water is sent from the low-pressure economizer 110 to the low-pressure steam drum 112. A part of the feed water in the low-pressure steam drum 112 is sent to the low-pressure evaporator 109 via the down tube 116, is heated in the low-pressure evaporator 109 by the exhaust gas, becomes a fluid mixture of steam and water, and is returned through the riser tube 117 to the low-pressure steam drum 112.

This fluid mixture of steam and water returned to the low-pressure steam drum 112 is separated into steam and water and the steam is sent through the steam pipe 120 to the low-pressure superheater 108, in which the steam is superheated.

Another part of the feed water in the low-pressure steam drum 112 passes through the feed water pipe 119, is boosted in pressure by the pump 118, and is sent to the high-pressure economizer 107. Then, in this high-pressure economizer 107, the feed water is heated by the exhaust gas and sent to the high-pressure steam drum 111. A part of the feed water sent to the high-pressure steam drum 111 is sent to the high-pressure evaporator 106 through the down tube 113, where it is heated by the exhaust gas and becomes a fluid mixture of steam and water, and is returned through the riser tube 114 to the high-pressure steam drum 111.

Within this high-pressure steam drum 111, the fluid mixture is separated into steam and feed water, the steam is sent through the steam pipe 115 to the primary superheaters 105, and in the primary superheaters 105, is superheated by the exhaust gas. Then the superheated steam is sent through the above-described communication pipe to the means for lowering the steam temperature. After the steam has been cooled to a predetermined temperature, it is sent to the secondary superheaters 102 where high-temperature, high-pressure steam is formed and is sent to the steam turbine.

The steam which has done work in the steam turbine is returned to the primary reheaters 104 where it is superheated. Then, this superheated steam is sent through the above-mentioned communication pipe to the means for lowering the steam temperature, wherein the steam temperature is cooled to a predetermined temperature. The steam is thereafter sent to the secondary reheaters 103 where it is again superheated.

In an exhaust gas boiler having reheaters, it is desirable, in order to effectively carry out recovery of heat from exhaust gas, that the conditions of the exhaust gas be the same as it enters both the superheaters and reheaters and that the conditions of the exhaust gas be the same as it leaves both the superheaters and reheaters. Similarly, it is desirable that the conditions of the steam be the same as it enters both the reheaters and superheaters and that the conditions of the steam be the same as it leaves both the superheaters and reheaters.

To that end, in the prior art, as described above superheaters and reheaters are divided into primary ones and secondary ones. The secondary superheaters 102 and the secondary reheaters 103 are disposed in parallel, the primary reheaters 104 are disposed on the downstream side of the secondary superheaters 102, and the primary superheaters 105 are disposed on the downstream side of the secondary reheaters 103. The primary superheaters 105 and the secondary superheaters 102 communicate with each other, and the primary reheaters 104 and the secondary reheaters 103 communicate with each other. Also, the exhaust gas flow path is divided and the gas flow is guided so as to form proper gas flows by providing partition walls 121 between the respective superheaters and the respective reheaters. In this manner, the gas temperatures immediately downstream of the primary superheaters 105 and the primary reheaters 104 are substantially the same.

The structure of the prior art exhaust gas boiler is, however, complicated due to the fact that the gas path is divided by the partition walls disposed between the superheaters and the reheaters.

SUMMARY OF THE INVENTION

It is therefore one object of the present invention to provide an improved reheat type exhaust gas boiler which is free from the above-described shortcomings of the exhaust gas boilers in the prior art.

A more specific object of the present invention is to provide a reheat type exhaust gas boiler, which is simple in structure and which can carry out recovery of heat from the exhaust gas more effectively than the prior art.

According to one feature of the present invention, there is provided a reheat type exhaust gas boiler, in which superheaters and reheaters are disposed in parallel in the most upstream portion in the direction of an exhaust gas flow within an exhaust gas boiler main body, and in which the superheaters and the reheaters are respectively divided into a plurality of stages. A high-temperature side superheater and a high-temperature side reheater are disposed in parallel in the most upstream portion of the gas flow. On the downstream side of the high-temperature side superheater is disposed a low-temperature side reheater, while on the downstream side of the high-temperature side reheater is disposed a low-temperature side superheater. The high-temperature side superheater and the high-temperature side reheater are formed so as to have an identical heat transfer tube outer diameter, an identical tube pitch in the widthwise direction of the main body (or flue), an identical tube pitch in the direction of the gas flow and an identical number of tube rows in the direction of the gas flow. The low-temperature side reheater and the low-temperature side superheater are formed so as to have an identical heat transfer tube outer diameter, an identical tube pitch in the widthwise direction of the flue, an identical tube pitch in the direction of the gas flow and an identical number of tube rows in the direction of the gas flow.

With the above-mentioned arrangement, since the high-temperature side superheater and the high-temperature side reheater disposed in parallel and the low-temperature side superheater and the low-temperature side reheater disposed in parallel, are respectively constructed so that their heat transfer tube outer diameters, their tube pitches in the widthwise direction of the flue, their tube pitches in the direction of the gas flow and the number of tube rows in the direction of the gas flow are identical to each other, the conditions which cause draft losses are identical, and accordingly, there is no need to provide partition walls for distributing the flow of exhaust gas.

The above-mentioned and other objects, features and advantages of the present invention will become more apparent by reference to the following description of a preferred embodiment of the invention taken in conjunction with the accompanying drawings.

DESCRIPTION OF THE PREFERRED EMBODIMENT

Detailed description of a preferred embodiment of the present invention will now be made with reference to FIGS. 1 and 2.

Figure 1:
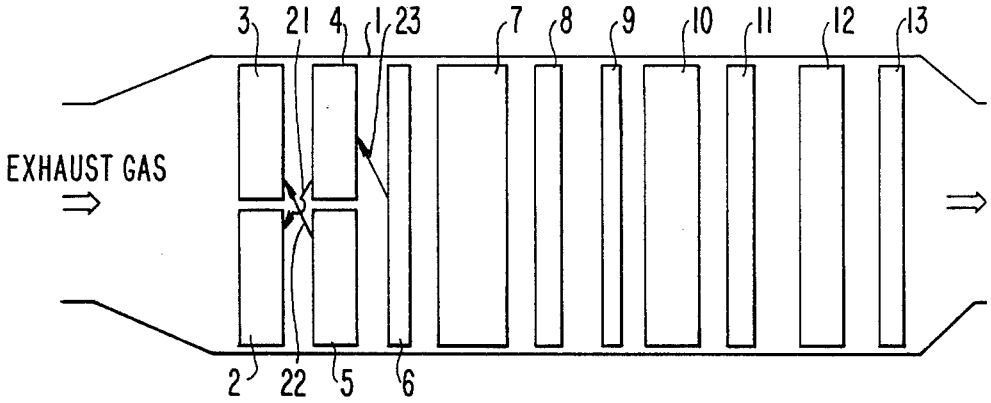
FIG. 1 is a schematic plan view showing a preferred embodiment of a reheat type exhaust gas boiler according to the present invention.
Figure 2:
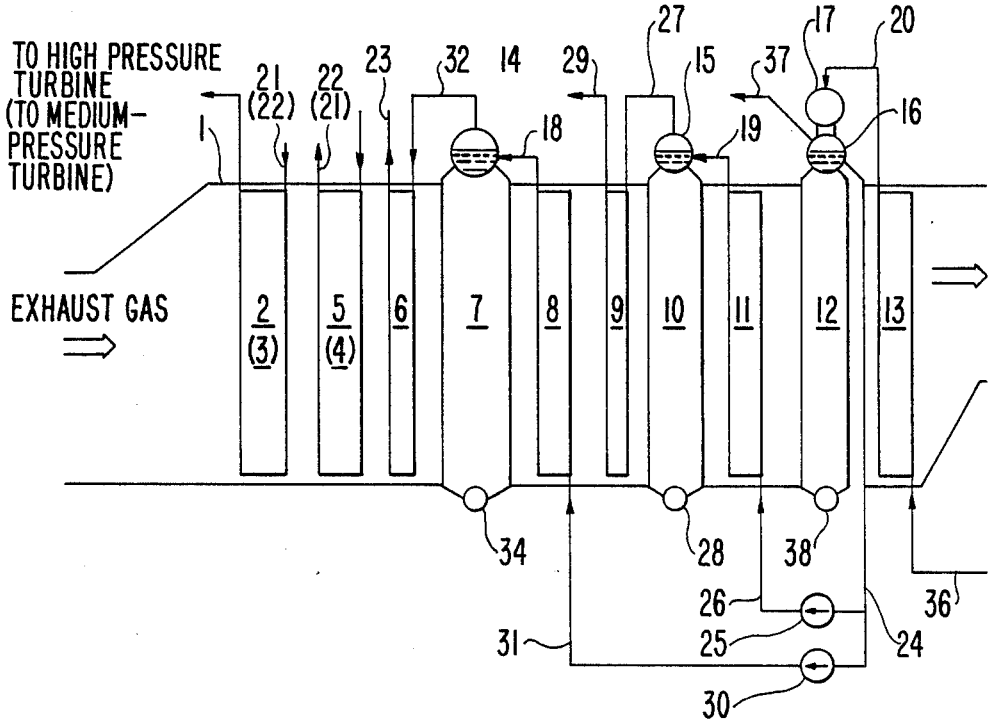
FIG. 2 is a schematic side view of the embodiment of FIG. 1.

As shown in FIGS. 1 and 2, a tertiary superheater 2 and a secondary reheater 3 are disposed parallel in an exhaust gas boiler main body 1 in the most upstream portion thereof with respect to the longitudinal and horizontal direction in which exhaust gas flows. On the downstream side of the tertiary superheater 2 is disposed a primary reheater 5, while on the downstream side of the secondary reheater 3 is disposed a secondary superheater 4. A primary superheater 6 extends over the entire transverse width of the main body (or flue) on the downstream side of the secondary superheater and primary reheater.

The secondary reheater 3 and the primary reheater 5 are connected through a communication pipe 22, the tertiary superheater 2 and the secondary superheater 4 are connected through a communication pipe 21, and the secondary superheater 4 and the primary superheater 6 are connected through a communication pipe 23.

On the downstream side of the primary superheater 6 are further disposed a high-pressure evaporator 7, a high-pressure economizer 8, a medium-pressure superheater 9, a medium-pressure evaporator 10, a medium-pressure economizer 11, a low-pressure economizer 12 and a low-pressure economizer 13, in sequence.

Above the exhaust gas boiler main body 1 are installed a high-pressure steam drum 14, a medium-pressure steam drum 15, a low-pressure steam drum 16 and a deaerator 17.

Thus, feed water (condensate) is fed from a condensate pump not shown, enters into the low-pressure economizer 13 through a pipe 36, and is sent to the deaerator 17 through a pipe 20 where it is deaerated by steam. Deaeration is provided by heated steam fed from the low-pressure steam drum 16. A part of the low-pressure steam in the low-pressure steam drum 16 is fed through a pipe 37 to a low-pressure steam turbine (not shown). This low-pressure steam drum 16 also serves as a water storage tank for the deaerator 17.

Another part of the water in the low-pressure steam drum 16 flows through a pipe 24 into a medium-pressure feed water pump 25 and a high-pressure feed water pump 30.

The feed water boosted in pressure by the medium-pressure feed water pump 25 passes through a pipe 26 into the medium-pressure economizer 11 where it is heated and then sent to the medium-pressure steam drum 15 through a pipe 19.

Steam generated in the medium-pressure evaporator 10 is fed to the medium-pressure superheater 9 through a pipe 27. The steam then flows into the primary reheater 5 via a pipe 29. In this case, since exhaust gas (steam) sent from a high-pressure turbine (not shown) is fed through the primary reheater 5, the medium-pressure steam fed through the pipe 29 is heated by the exhaust gas sent from the high-pressure turbine at the upstream side of the primary reheater 5.

Furthermore, steam is sent to the secondary reheater 3 through the communication pipe 22, and after it has been heated there, it is sent to a medium-pressure turbine. It may be necessary to provide in communication pipe 22 a means for lowering the steam temperature. Such means is preferably of a water spray injection type or the like.

Subsequently, the feed water boosted in pressure by means of the high-pressure feed water pump 30 reaches the high-pressure economizer 8 through a pipe 31 where it is heated and then sent to the high-pressure steam drum 14 through a pipe 18.

Steam generated in the high-pressure evaporator 7 is sent through a pipe 32 to the primary superheater 6 where it is heated and then sent to the secondary superheater 4 via the communication pipe 23. After the steam has been heated in the secondary superheater, it is sent to the tertiary superheater 2 through the communication pipe 21. Steam is sent through the outlet of the tertiary superheater 2 to a high-pressure turbine (not shown).

In this case, it may be necessary to provide a means for lowering steam temperature in communication pipes 21 or 23 by water spray injection or the like to thereby regulate the steam temperature.

It is to be noted that in FIG. 2, reference numeral 28 designates a medium-pressure evaporator bottom drum, numeral 34 designates a high-pressure evaporator bottom drum, and numeral 38 designates a low-pressure evaporator bottom drum.

Figure 1A:
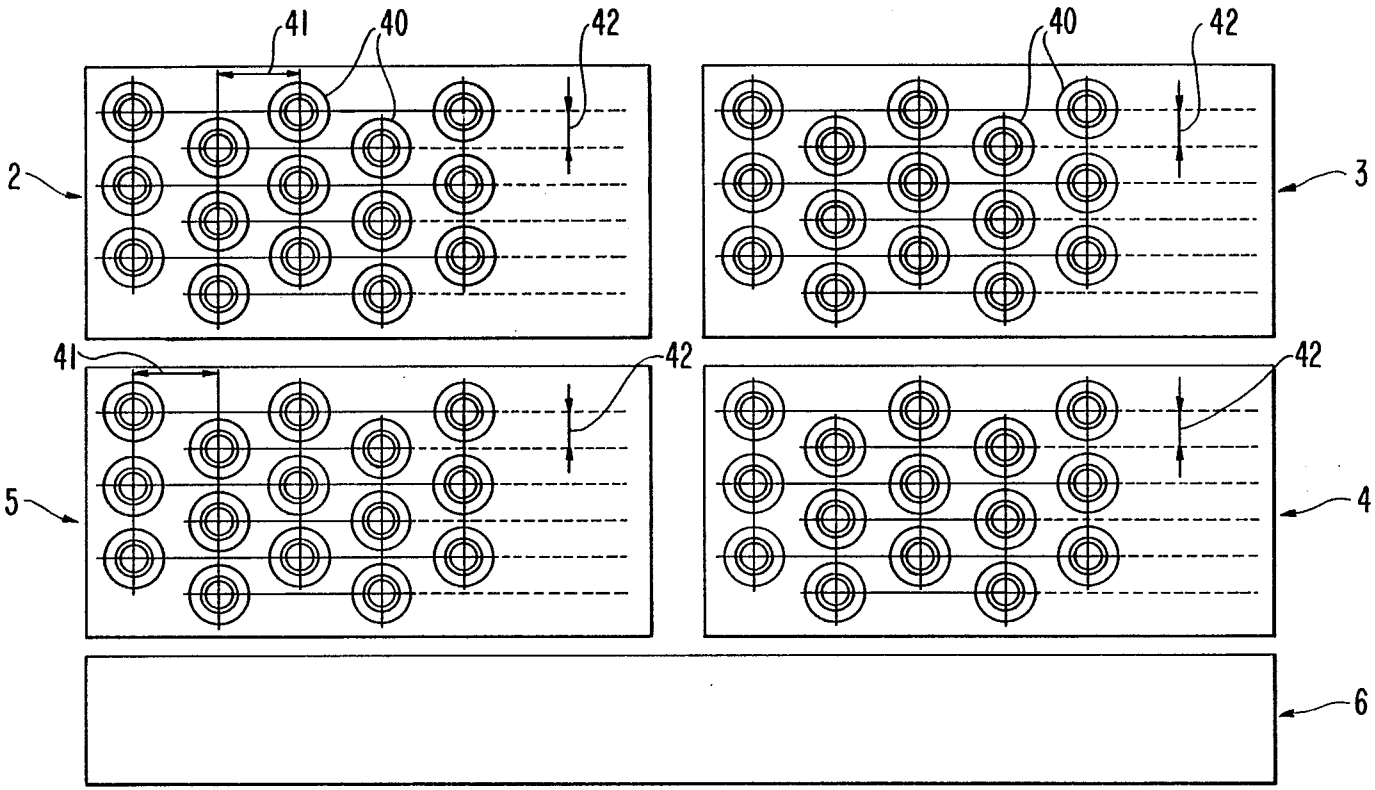
FIG. 1A is an enlarged schematic plan view of part of FIG. 1 showing heat transfer tubes according to the invention.
Figure 3:
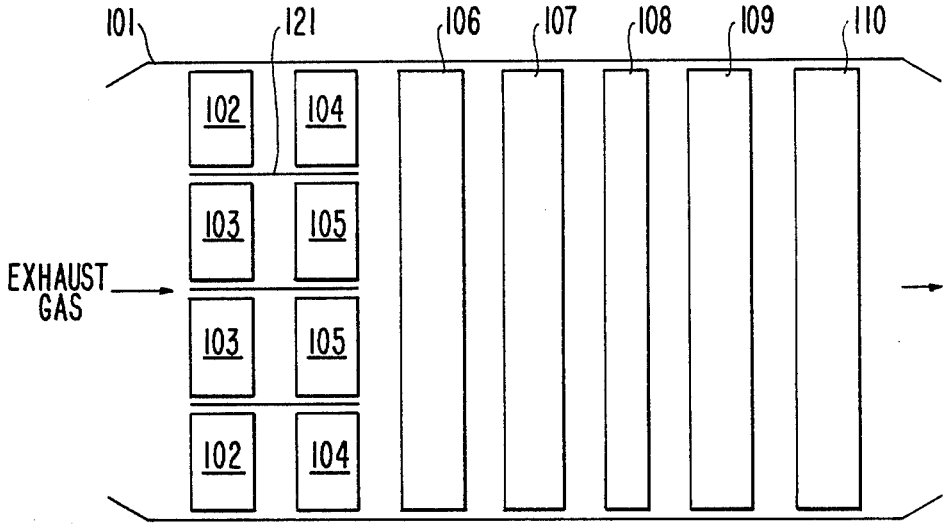
FIG. 3 (PRIOR ART)
FIG. 3 is a schematic plan view showing one example of a prior art reheat type exhaust gas boiler.
Figure 4:
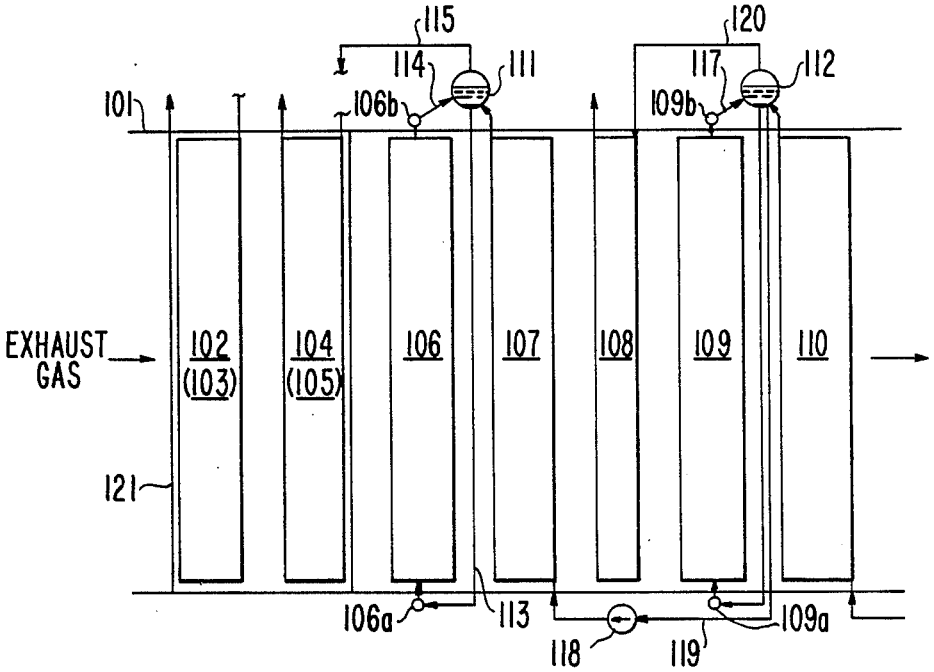
FIG. 4 (PRIOR ART)
FIG. 4 is a schematic side view of the exhaust gas boiler of FIG. 3.

In the above described construction of the reheat type exhaust gas boiler according to the present invention, the tertiary superheater 2 and the secondary reheater 3 disposed in parallel both have heat transfer tubes 40 with identical outer diameters, tube pitches 41 in the transverse widthwise direction of the flue, tube pitches 42 in the longitudinal direction of the gas flow and numbers of tube rows in the direction of the gas flow, so that the resistance against the gas flow is identical along the transverse widthwise direction of the flue (see FIG. 1A).

As described above, by arranging the tertiary (or high-temperature side) superheater 2 and the secondary (or high-temperature side) reheater 3 in parallel, and the secondary (or low-temperature side) superheater 4 and the primary (or low-temperature side) reheater 5 in parallel in such a manner that their resistances against gas flow are identical along the transverse widthwise direction of the flue, draft losses are identical along the transverse direction so that gas flow is constant. Accordingly, there is no need to provide partition walls for specially dividing gas flow paths between the parallel superheaters and reheaters.

It is to be noted that while the exhaust gas boiler has been described as including the deaerator 17, the low-pressure economizer 13, as well as the medium-pressure evaporator 10, the medium-pressure superheater 9 and the primary superheater 6, it may not always be essential to include each and every one of these elements.

Accordingly, the present invention may comprise an exhaust gas boiler which does not include the deaerator 17 and the low-pressure economizer 13. Likewise, the present invention may comprise an exhaust gas boiler which does not have a medium-pressure superheater 9. Furthermore, in some cases, the primary superheater 6 can be omitted.

As described in detail above, according to the present invention, the gas flow about the parallel superheaters and reheaters can always be maintained constant along the transverse widthwise direction of the flow without providing partition walls to divide gas flow paths between the high-temperature side superheater and the high-temperature side reheater and between the low-temperature side superheater and the low-temperature side reheater, which are respectively disposed in parallel in the most upstream portion of the exhaust gas boiler main body. Therefore, recovery of heat from the exhaust gas can be achieved effectively while simplifying the structure of the exhaust gas boiler.

While a principle of the present invention has been described above generally in connection with one preferred embodiment of the invention, it is a matter of course that many apparently widely different embodiments of the present invention can be made without departing from the spirit of the invention.

What is claimed is:

1. A reheat type exhaust gas boiler comprising:

an exhaust gas boiler main body through which exhaust gases are adapted to flow in a generally longitudinal direction;

a high-temperature side superheater and a high-temperature side reheater mounted in parallel in a most upstream portion of said main body and each including a plurality of heat transfer tubes;

a low-temperature side reheater including a plurality of heat transfer tubes and being mounted in said main body on a downstream side of said high-temperature side superheater;

a low-temperature side superheater including a plurality of heat transfer tubes and being mounted in said main body on a downstream side of said high-temperature reheater;

said plurality of heat transfer tubes of said high-temperature side superheater having tube outer diameters, a number of rows along the longitudinal direction and pitches in both the longitudinal and transverse directions equal to those of said plurality of heat transfer tubes of said high-temperature side reheater; and said plurality of heat transfer tubes of said low-temperature side superheater having tube outer diameters, a number of rows along the longitudinal direction and pitches in both the longitudinal and transverse directions equal to those of said plurality of heat transfer tubes of said low-temperature side reheater.

2. A reheat type exhaust gas boiler as recited in claim 1, further comprising a primary superheater mounted transversely in said main body on a downstream side of said low temperature side superheater and said low-temperature side reheater; and an outlet of said primary superheater being fluidically connected to an inlet of said low-temperature side superheater.

* * * * *